US006294978B1

(12) United States Patent
Endo et al.

(10) Patent No.: US 6,294,978 B1
(45) **Date of Patent: *Sep. 25, 2001**

(54) HIGH-CURRENT FUSE FOR VEHICLES

(75) Inventors: Takayoshi Endo; Norio Matsumura; Shigemitsu Inaba; Atsushi Hikage; Shinya Onoda, all of Shizuoka (JP)

(73) Assignee: Yazaki Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/267,698

(22) Filed: Mar. 15, 1999

(30) Foreign Application Priority Data

Mar. 16, 1998 (JP) ..... 10-065486
Sep. 21, 1998 (JP) ..... 10-265936
Dec. 25, 1998 (JP) ..... 10-369339

(51) Int. Cl.[7] ..... H01H 85/47; H01H 85/165

(52) U.S. Cl. ..... 337/166; 337/186; 337/159; 337/293

(58) Field of Search ..... 337/186, 159, 337/166, 180, 227, 241, 280, 290, 293; 29/623

(56) References Cited

U.S. PATENT DOCUMENTS 3,810,063 * 5/1974 Blewitt ..... 337/166
3,883,838 * 5/1975 Bogert et al. ..... 337/295
4,050,045 * 9/1977 Motten, Jr. et al. ..... 337/187
4,216,456 * 8/1980 Hotta et al. ..... 337/114
4,263,574 * 4/1981 Mori et al. ..... 337/161
4,460,948 * 7/1984 Malola ..... 362/396
4,839,625 * 6/1989 Newbery et al. ..... 337/166
5,214,565 * 5/1993 Flores ..... 361/386
5,643,693 * 7/1997 Hill et al. ..... 429/121
5,645,448 * 7/1997 Hill ..... 439/522

FOREIGN PATENT DOCUMENTS 61-66387 4/1986 (JP) .
62-118336 7/1987 (JP) .
64-16661 1/1989 (JP) .

* cited by examiner

*Primary Examiner*—Gerald Tolin
*Assistant Examiner*—Anatoly Vortman
(74) *Attorney, Agent, or Firm*—Armstrong, Westerman, Hattori, McLeland & Naughton, LLP

(57) ABSTRACT

A high-current fuse for vehicles is provided. This high-current fuse includes a conductive plate having a fuse and terminal connecting portions on both ends, and a resin case into which the conductive plate is insert-molded. A heat radiating portion for releasing heat generated from the fuse and the conductive plate when energized is provided on the outer surface of the resin case. The heat radiating portion is made up of a plurality of thin plates arranged on the resin case at regular intervals. The thin plates are situated in parallel with the energizing direction so as to strengthen the resin case. To keep the fuse away from both ends of the conductive plate, a pair of assisting plates facing to each other are formed in the middle of the conductive plate, and the fuse is disposed between the assisting plates. The fuse between the assisting plates is in the direction perpendicular to the energizing direction of the conductive plate.

5 Claims, 13 Drawing Sheets

PRIOR ART

HIGH-CURRENT FUSE FOR VEHICLES

BACKGROUND OF THE INVENTION

1. Field of the Invention

The present invention relates to a high-current fuse for vehicles which can restrict a temperature rise when energized.

2. Description of the Related Art Japanese Patent Application Laid-Open No. 610-66387 discloses a fuse 90 shown in FIG. 26.

The fuse 90 comprises a pair of tab-like terminals 91, a fusible element 92 disposed between the tab-like terminals 91, and a resin frame 93 integrally formed around the fusible element 92. The resin frame 93 is rectangular and includes the connecting portion between the tab-like terminals 91 and the fusible element 92. If the value of a rated current J' flowing through the tab-like terminals 91 is too large, the fusible element 92 generates heat and fuses with the heat. By doing so, excess current can be prevented from flowing into an auxiliary equipment (not shown) connected to the tab-like terminals 91.

However, since the heat generated from the fusible element 92 is transmitted to the resin frame 93, which is in contact with the fusible element 92, there is always a possibility that the resin frame 93 melts. To prevent this, it is necessary to put restrictions on environments and conditions in which the fuse 90 can be used, and the rated current J' flowing through the fuse 90.

Also, if the fuse 90 is placed in a high-temperature condition, tensile stress and compressive stress act directly upon the fusible element 92 due to the difference in linear expansion coefficient between the tab-like terminals 91 and the resin frame 93, thereby reducing the durability of the fuse 90.

There has also been disclosed a fuse box 94 having a fuse as shown in FIG. 27.

The fuse box 94 comprises a main box 95, an L-shaped bus bar 96 connected to a side wall of the main box 95, and a cover 97 attached below the main box 95. The main box 95 is fixed to one end of the bus bar 96, and a battery connecting portion 95*a* is attached to the other end of the bus bar 96. The battery connecting portion 95*a* is connected to the battery post 98*a* of a battery (storage battery) 98. A fuse 99 is inserted into the upper portion of the main box 95, and a terminal (not shown) for the fuse 99 is inserted into the lower portion of the main box 95.

However, the production cost of the fuse box 94 is high due to the large number of components. Also, the fuse box 94 has a drawback that the length between the battery connecting portion 95*a* and the fuse 99 is too long, because the fuse 99 is arranged in line with the bus bar 96. Accordingly, there is always a possibility that the fuse box 94 becomes too big in size.

SUMMARY OF THE INVENTION

The principal object of the present invention is to provide a high-current fuse which can be used in less restricted environments, has high durability, consists of a small number of components, and is small in size.

To achieve the above object, the present invention provides a high-current fuse for vehicles which includes a conductive plate having a fuse and terminal connecting portion on both sides, a resin case into which the conductive plate is insert-molded, and a heat radiating portion for releasing heat generated from the fuse and the conductive plate when energized. The heat radiating portion is disposed on the outer surface of the resin case.

With this structure, the number of components can be smaller than in the prior art, and the high-current fuse can be made compact. Such a high-current fuse for vehicles can be connected with ease even in a small installation space. Also, as the heat radiating portion is disposed on the outer surface of the resin case, the heat generated from the fuse and the conductive plate can be quickly released. Thus, a temperature rise in the resin case can be restricted, and the resin case can be prevented from melting with heat. Functional deterioration of the resin case can also be prevented.

In accordance with a second aspect of the present invention, the terminal connecting portions on both sides of the conductive plate are arranged on the same line with a space in between, and the fuse is arranged in between.

With this structure, the terminal connecting portions on both sides can be brought closer, so that the high-current fuse can be made smaller.

In accordance with a third aspect of the present invention, one of the terminal connecting portions is directly attached to a battery.

With this structure, the fuse can be automatically attached directly to the battery. Accordingly, the fuse member can be easily connected to the battery, and unlike in the prior art, a failure of connecting the fuse member to the battery can be prevented.

In accordance with a fourth aspect of the present invention, the heat radiating portion comprises a plurality of thin plates arranged on the resin case at regular intervals.

With this structure, the surface area of the resin case can be increased, so that a larger area of the resin case is brought into contact with air, and that the heat radiating effect of the resin case can be improved. Accordingly, a temperature rise can be restricted at the time of energization, and the environment and the condition when the high-current fuse is used can be less restrictive. Also, a wider range of current can flow through the conductive plate.

In accordance with a fifth aspect of the present invention, the thin plates are arranged in parallel with the energizing direction so as to strengthen the resin case.

With this structure, the rigidity of the resin case can be secured. Such a high-current fuse for vehicles does not easily bend, and thus has higher reliability as a product.

In accordance with a sixth aspect of the present invention, a pair of assisting plates facing to each other are integrally formed in the middle of the conductive plate, and the fuse is disposed between the pair of assisting plates.

With this structure, the fuse can be kept away from both ends of the conductive plate by the length of the pair of assisting plates. When the conductive plate is energized from one end to the other via the fuse, a temperature rise at the terminal connecting portions is smaller than in the prior art.

In accordance with a seventh aspect of the present invention, the fuse disposed between the pair of assisting plates is in a direction perpendicular to the energizing direction of the conductive plate.

With this structure, even if the high-current fuse for vehicles is placed under a high-temperature condition, tensile stress and compressive stress caused by the difference in linear expansion coefficient between the resin case and the conductive plate do not act directly on the fusible element of the fuse. Thus, the fuse can be more durable than in the prior art at a high temperature.

The above and other objects and features of the present invention will become more apparent from the following description taken in conjunction with the accompanying drawings.

DESCRIPTION OF THE PREFERRED EMBODIMENTS

Figure 1:
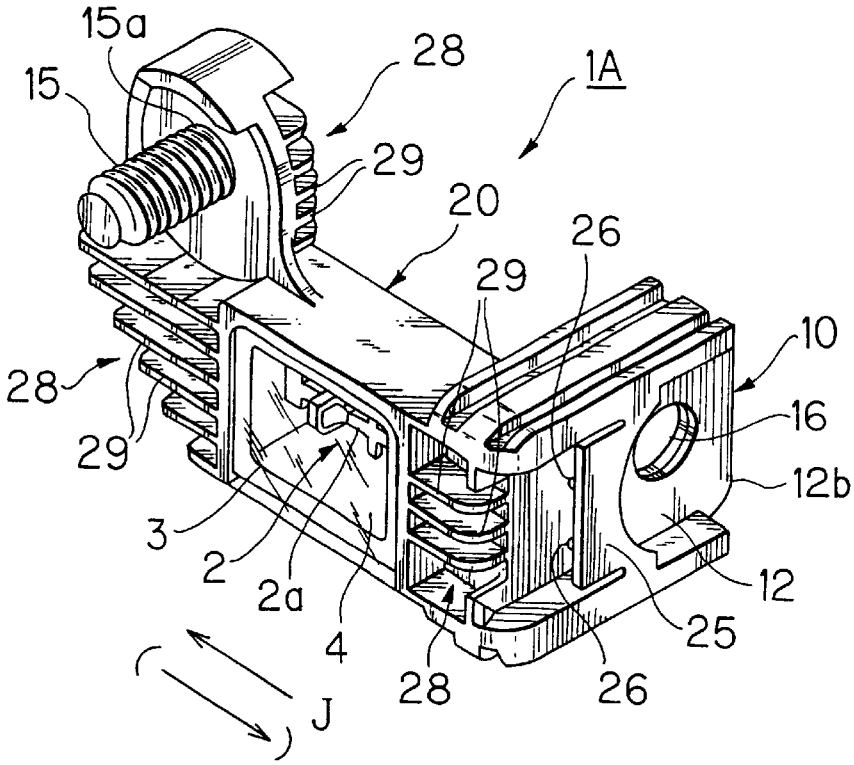
FIG. 1 is a perspective view of a first embodiment of the high-current fuse for vehicles in accordance with the present invention.

The following is a detailed description of embodiments of the present invention, with reference to the accompanying drawings.

FIGS. 1 to 4 illustrate a first embodiment of the high-current fuse for vehicles of the present invention.

As shown in FIGS. 1 to 4, the high-current fuse 1A comprises a conductive plate 10 formed by stamping a metal plate, a resin case 20 accommodating the conductive plate 10, and beat radiating portions 28 formed on the outer surfaces of the resin case 20.

The conductive plate 10 comprises a pair of flat plates 11 and a curved plate 12 communicating with a second end portion 11*b* of the flat plates 11. The second end portion 11*b* of the flat plates 11 and a first end portion 12*a* of the curved plate 12 form the conductive plate 10 into an L-shape. A first end portion 11*a* of the flat plates 11 is provided with an extension plate 13 on its one side. A bolt opening 15*a* is formed in the center of the extension plate 13. After insertion molding, a stud bolt 15 is inserted upward into the bolt opening 15*a*. The curved plate 12 is substantially perpendicular to the flat plates 11. A second end portion 12*b* of the curved plate 12 is provided with an attachment hole 16.

Figure 2:
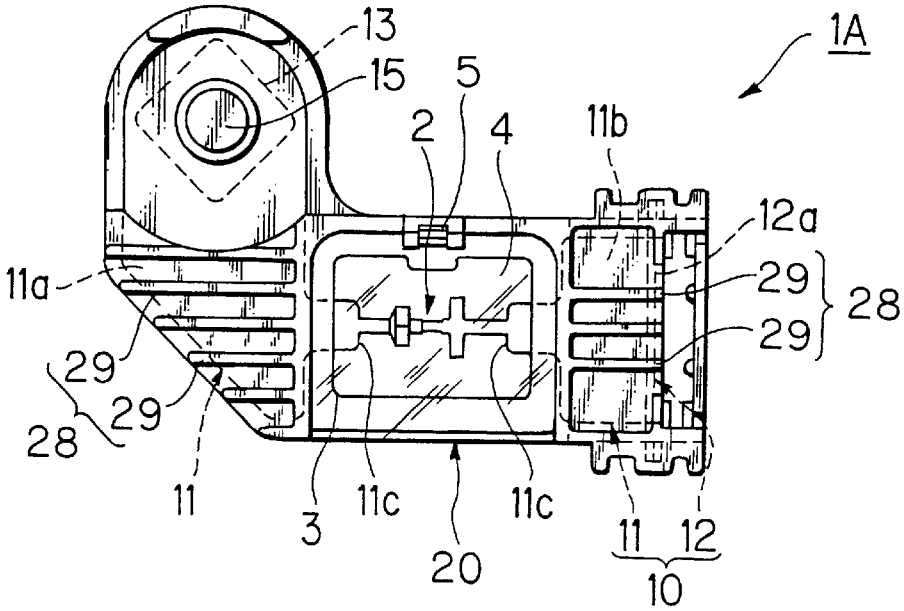
FIG. 2 is a plan view of the high-current fuse of FIG. 1.
Figure 3:
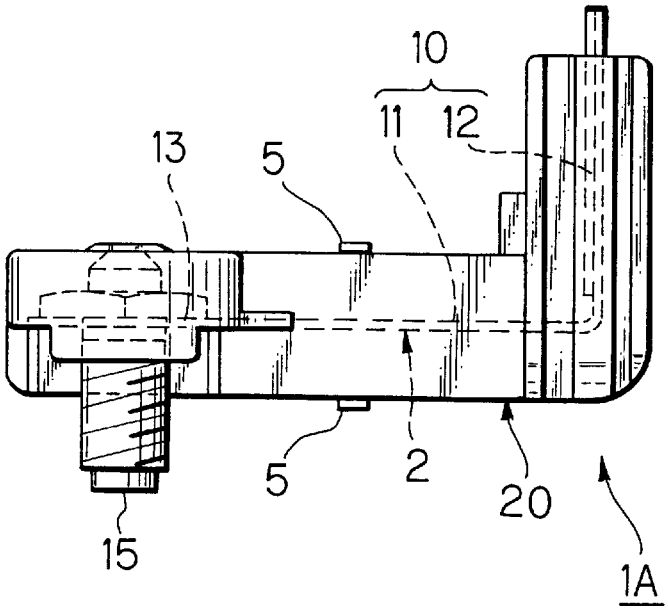
FIG. 3 is a front view of the high-current fuse of FIG. 1.
Figure 4:
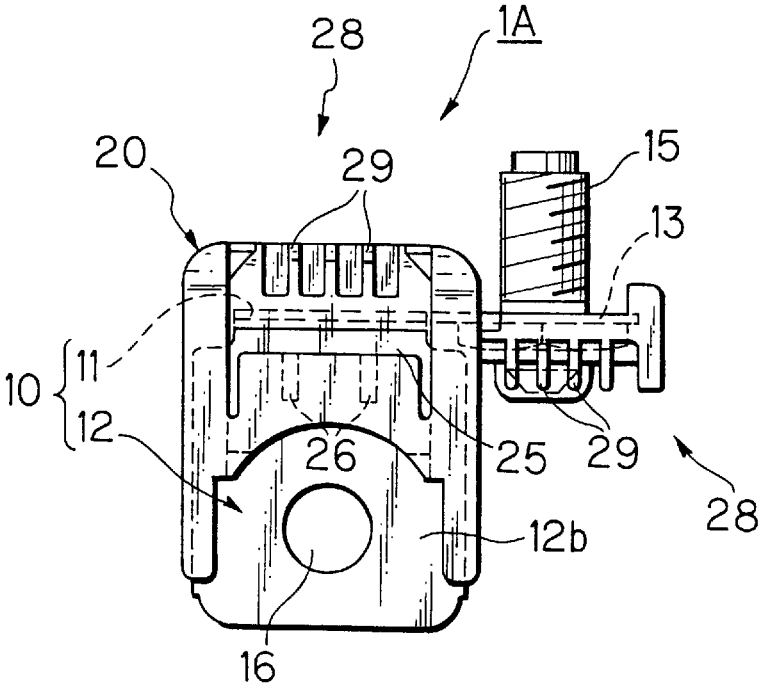
FIG. 4 is a side view of the high current fuse of FIG. 1.
Figure 5:
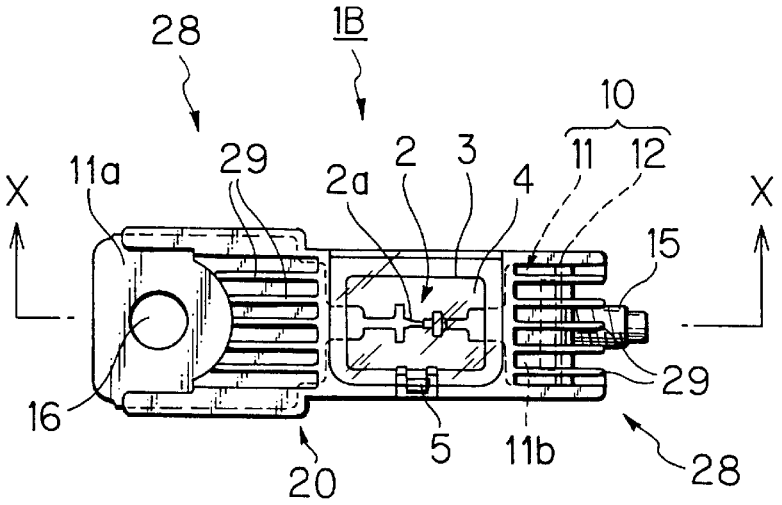
FIG. 5 is a plan view of a second embodiment of the high-current fuse for vehicles in accordance with the present invention.
Figure 6:
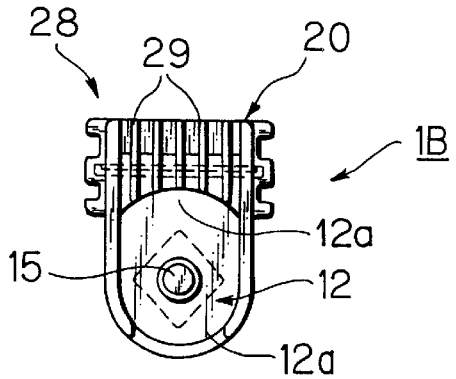
FIG. 6 is a side view of the high-current fuse of FIG. 5.
Figure 7:
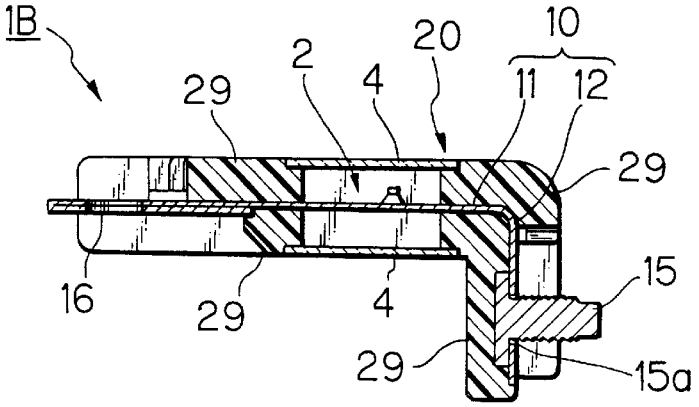
FIG. 7 is a sectional view of the high-current fuse taken along the line X—X of FIG. 5.
Figure 8:
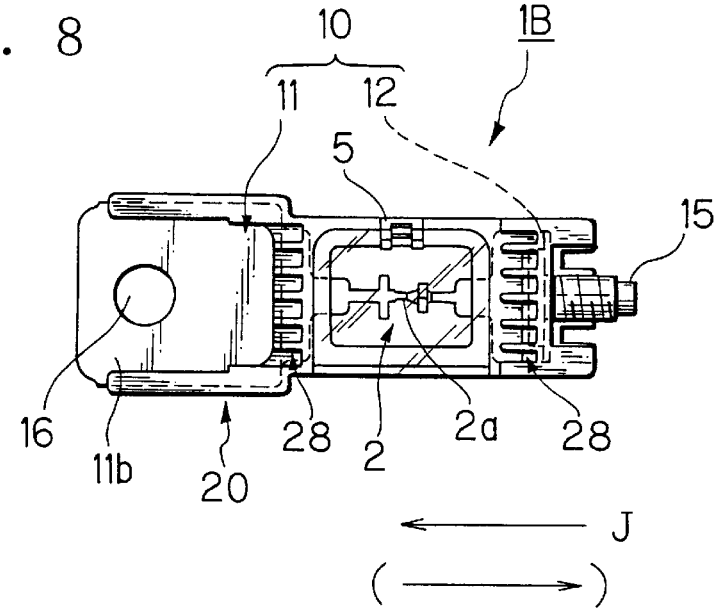
FIG. 8 is a rear view of the high-current fuse of FIG. 5.
Figure 9:
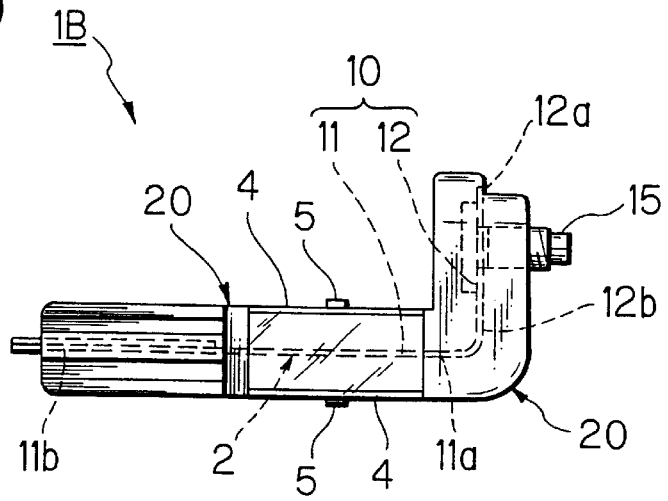
FIG. 9 is a front view of the high-current fuse of FIG. 5.

As shown in FIGS. 1 and 2, a pair of end portions 11*c* facing to each other are provided between the flat plates 11, and a fuse 2 is integrally formed between the pair of end portions 11*c*. Accordingly, the first end portion 11*a* and the second end portion 11*b* of the flat plates 11 are situated in line with the fuse 2. The fuse 2 has a fusible element 2*a* which fuses with its own heat generation when energized.

The resin case 20 is provided with a rectangular stopper frame 25 for holding a terminal (not shown), and two protrusions 26 are arranged on the inner surface of the stopper frame 25.

The stud bolt 15 is screwed into a terminal (a plate-like terminal or a round-type terminal, for instance). The flat plates 11 and the extension plate 13 are on the same plane, and the flat plates are substantially perpendicular to the curved plate 12.

A stud bolt (not shown) standing on the device side is inserted into the attachment hole 16, and an auxiliary equipment or terminal (not shown) is screwed into the curved plate 12, so that they can be electrically connected.

The conductive plate 10 is inserted into a resin material (not shown), excluding the upper surface of the extension plate 13 and both side surfaces of the curved plate 12. The resin case 20 is provided with a window 3 in a position corresponding to the fuse 2. The fuse can be insert-molded so as not to be covered by a resin material. The window 3 is covered with a transparent cover 4. With the transparent cover 4, it becomes possible to instantly determine from outside whether the fuse 2 has fused or not. Also, with the conductive plate 10 being inserted into the resin case 20, the fuse 2 can be made waterproof, and the rigidity of the conductive plate 10 itself can be improved.

The heat radiating portions 28 radiate heat generated from the conductive plate 10 or the fuse 2 through the resin case 20. One of the heat radiating portions 28 is disposed on the lower surface of the resin case 20. The upper surface of the resin case 20 corresponding to the first end portion 11*a* and the second end portion 11*b* of the flat plates 11 is provided with another heat radiating portion 28. Such heat radiating portions 28 can be disposed in other positions.

Each of the heat radiating portions 28 comprises a plurality of thin plates 29 arranged at equal intervals. Because of this, the surface area of the resin case 20 is larger than that of a resin case without the heat radiating portions 28. Since the surfaces of the resin case are exposed to air, the heat generated in the resin case 20 is quickly released. Thus, the heat radiation effect of the resin case 20 can be improved.

The thin plates 29 are arranged in the same direction as the direction J in which current flows through the conductive plate 10, so as to strengthen the resin case 20. Thus, the rigidity of the resin case 20 can be secured.

As described above, since the heat generated from the fuse 2 or the conductive plate 10 can be surely released to the outside at the time of energization, a temperature rise in the resin case 20 can be restricted, and a functional deterioration due to the heat from the resin case 20 and the terminal connecting portion (i.e., the stud bolt 15 and the attachment hole 16) can be prevented. Thus, the environment and condition can be less restricted when the high-current fuse 1A is used. Also, a wider value range of current can flow through the conductive plate 10 and the fuse 2.

FIGS. 5 to 11 illustrate a second embodiment of the high-current fuse for vehicles in accordance with the present invention. It should be noted here that like components are indicated by like reference numerals in this embodiment and the first embodiment.

As shown in FIGS. 5 to 9, the high-current fuse 1B comprises a conductive plate 10 formed by stamping a metal plate, a resin case 20 insert-molded and containing the conductive plate 10 inside, and heat radiating portions 28 formed on the outer surfaces of the resin case 20.

The conductive plate 10 comprises a pair of flat plates 11 and a curved plate 12 communicating with a second end portion 11*b* of the flat plates 11. The second end portion 11*b* of the flat plates 11 and a first end portion 12*a* of the curved plate 12 form the conductive plate 10 into an L-shape. An attachment hole 16 is formed at a first end portion 11*a* of the flat plates 11. The curved plate 12 is substantially perpendicular to the flat plates 11. A bolt opening 15*a* (not shown) is formed at a second end portion 12*a* of the curved plate 12, and after the insertion molding, a stud bolt 15 is screwed into the bolt opening 15*a*. As in the first embodiment, the fuse 2 is integrally formed between the flat plates 11. Accordingly, the first and second end portions 11*a* and 11*b* of the flat plates 11 are situated in line with the fuse 2. The fuse 2 is provided with a fusible element 2*a* which fuses with its own heat generation when energized.

The resin case 20 is formed by insert-molding both surfaces of the conductive plate 10 with a resin material so as not to include the areas surrounding the attachment hole 16 and the bolt opening 15*a*.

The resin case 20 is provided with a window 3 which is covered with a transparent cover 4. The conductive plate 10 can be insert-molded with a resin material in such a manner that the fuse 2 is not covered with the resin material. The window 3 is provided with a stopper for holding the transparent cover 4.

The heat radiating portions 28 are provided onto the surfaces of the flat plates 11 and the curved plate 12. The structure of the heat radiating portions 28 are the same as those in the first embodiment.

Figure 10:
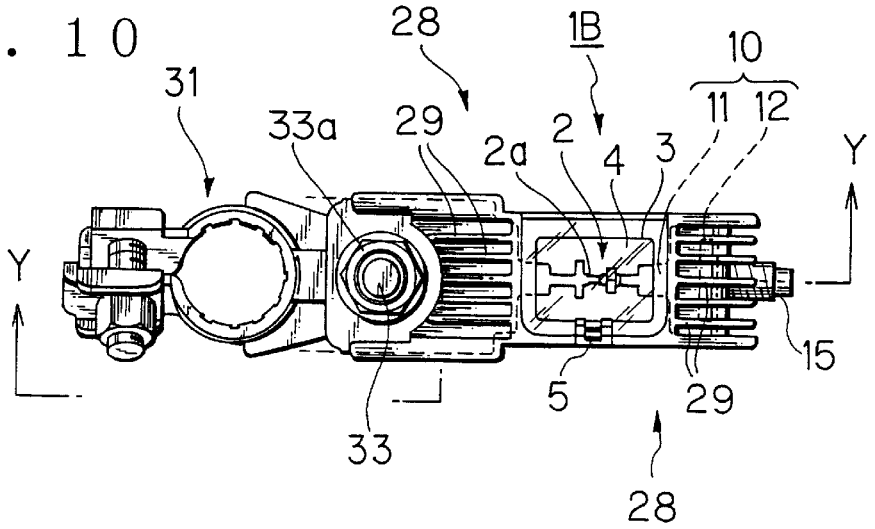
FIG. 10 is a plan view of the high-current fuse of the second embodiment attached to a terminal on the battery side.

FIG. 10 illustrates the high-current fuse 1B and a battery connecting terminal 31 connected to each other. A bolt (or a screw) 33 is inserted into the attachment hole 16 of the high-current fuse 1B, and the battery connecting terminal 31 is screwed into the bolt 33 by a nut 33*a*. In this case, the fuse 2 is disposed between the flat plates 11, and the conductive plate 10 is situated in line with the fuse 2. Accordingly, the battery connecting terminal 31 is situated in line with the fuse 2.

Figure 11:
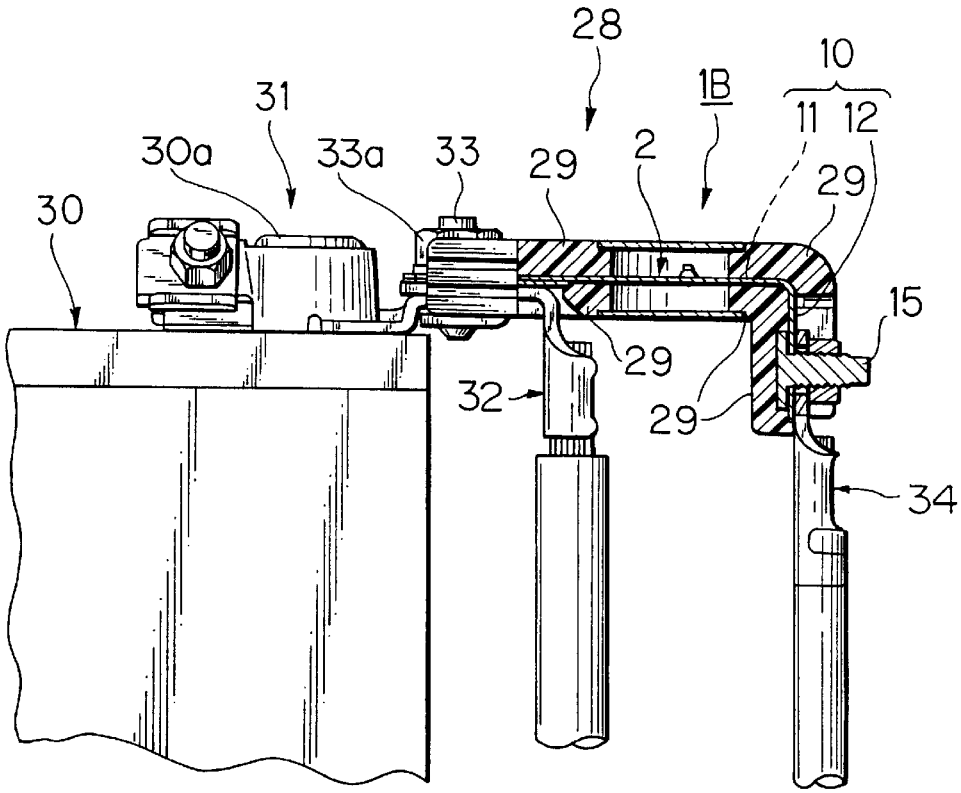
FIG. 11 is a sectional view of the high-current fuse taken along the line Y—Y of FIG. 10.

FIG. 11 illustrates the battery connecting terminal 31 attached to the high-current fuse 1B and connected to a battery 30.

A first terminal 32 is connected to the bolt 33, and a second terminal 34 is connected to the stud bolt 15. A battery post is linearly connected to the fuse via the battery connecting terminal. The conductive plate 10 of the high-current fuse 1B can be directly attached to the battery post 30*a* of the battery 30.

Figure 12:
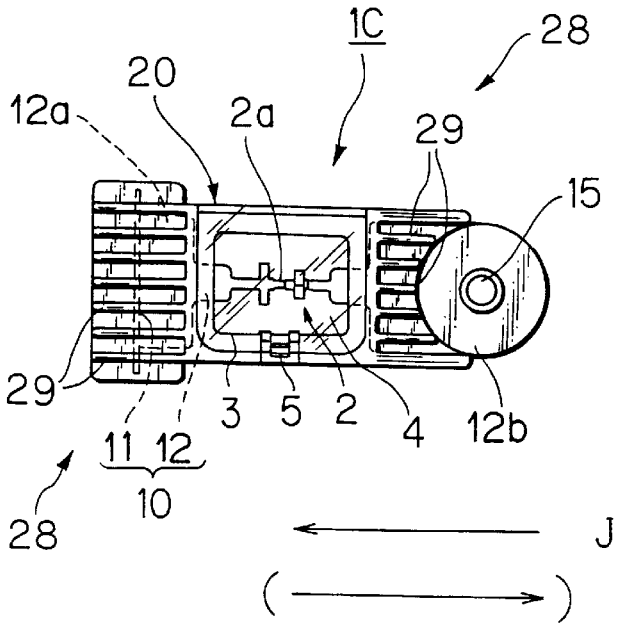
FIG. 12 is a plan view of a third embodiment of the high-current fuse for vehicles in accordance with the present invention.
Figure 13:
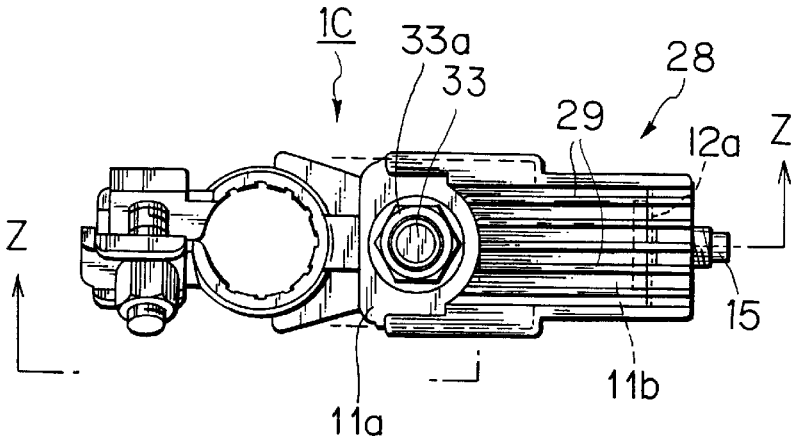
FIG. 13 is a plan view of the high-current fuse of FIG. 12 attached to a terminal of the battery side.
Figure 14:
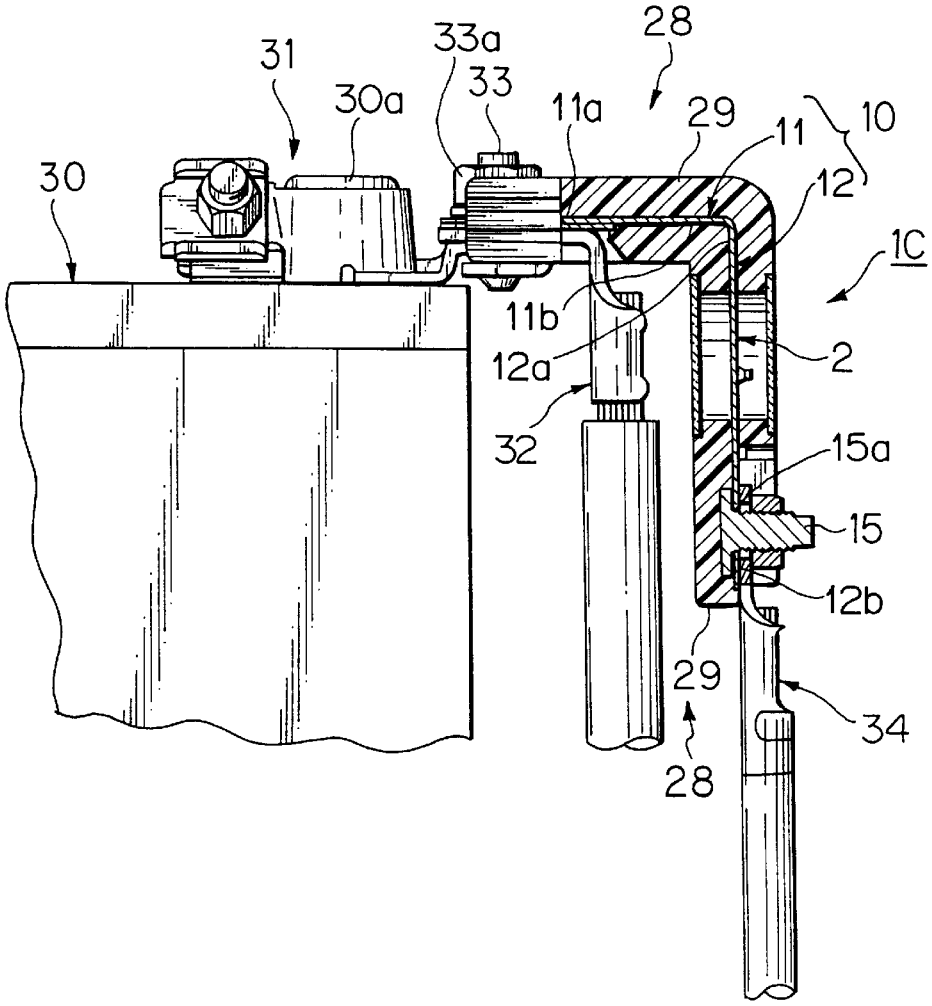
FIG. 14 is a sectional view of the high current fuse taken along the line Z—Z of FIG. 13.

FIGS. 12 to 14 illustrate a third embodiment of the high-current fuse for vehicles in accordance with the present invention. It should be noted here that like reference numerals indicate like components in the first embodiment and this embodiment.

As shown in FIGS. 12 to 14, the high-current fuse 1C comprises a conductive plate 10 formed by stamping a metal plate, a resin case 20 insert-molded and containing the conductive plate 10 inside, and heat radiating portions 28 formed on the outer surfaces of the resin case 20.

The conductive plate 10 comprises a pair of flat plates 11 and a curved plate 12 communicating a second end portion 11*b* of the flat plates 11. The second end portion 11*b* of the flat plates 11 communicates with a first end portion 12*a* of the curved plate 12, so that the conductive plate has an L-shape. An attachment hole 16 is formed at a first end portion 11*a* of the flat plates 11. The curved plate 12 is substantially perpendicular to the flat plates 11. A bolt opening 15*a* (not shown) is formed at a second end portion 12*b* of the curved plate 12, and after insertion molding, a stud bolt 15 is secured into the bolt opening 15*a*. As in the first embodiment, a fuse 2 is integrally formed in the mid section of the curved plate 12. Accordingly, the first end portion 12*a* and the second end portion 12*b* of the curved plate 12 are situated in line with the fuse 2.

The resin case 20 is formed by insert-molding the conductive plate 10 into a resin material so as not to include the areas surrounding the attachment hole 16 and the bolt opening 15*a*.

The resin case 20 is provided with a window 3 which is covered with a transparent cover 4. Here, the conductive plate 10 may be insert-molded into a resin material in a manner that prevents the fuse 2 from being covered with the resin material. The window 3 is provided with a stopper for holding the transparent cover 4.

The heat radiating portions 28 are disposed on the outer surfaces of the flat plates 11 and the curved plate 12. The structure of the heat radiating portions 28 is the same as that of the first embodiment.

FIG. 13 corresponds to FIG. 10 of the second embodiment, and FIG. 14 corresponds to FIG. 11 of the second embodiment.

In FIG. 13, a bolt 33 inserted into the attachment hole 16 is screwed into a battery connecting terminal 31 by a nut 33*a*.

As shown in FIG. 14, the battery post 30*a* of a battery 30 is connected to the battery connecting terminal 31. A first terminal 32 is electrically connected to the bolt 33, and a second terminal 34 to the stud bolt 15. Here, the battery connecting terminal 31 is situated in line with the flat plates 11, but not with the fuse 2.

FIGS. 15, 16, 17A and 17B illustrate a fourth embodiment of the high-current fuse for vehicles in accordance with the present invention. It should be noted here that like reference numerals indicate like components in the first embodiment and this embodiment.

Figure 15:
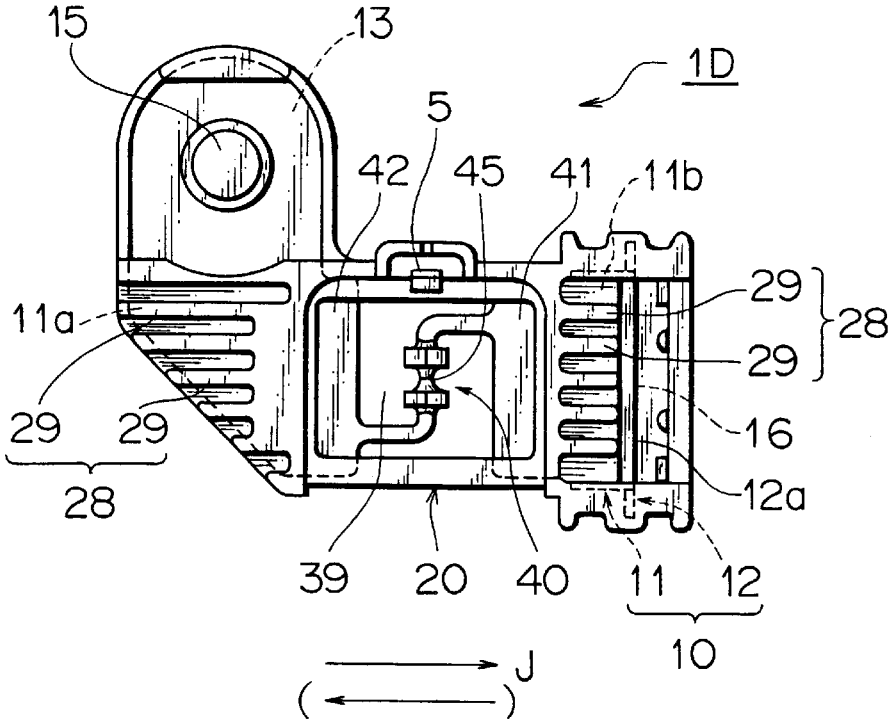
FIG. 15 is a plan view of a fourth embodiment of the high-current fuse for vehicles in accordance with the present invention.
Figure 16:
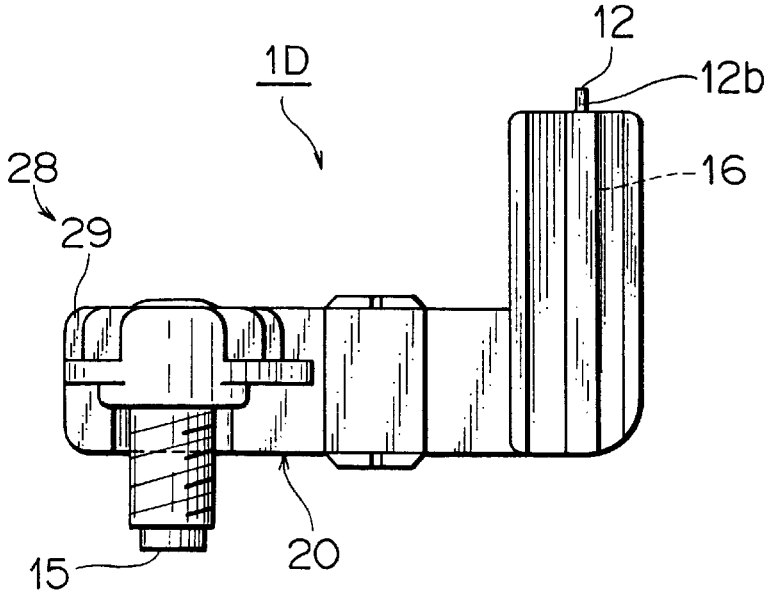
FIG. 16 is a side view of the high-current fuse of FIG. 15.

As shown in FIGS. 15 and 16, the high-current fuse of this embodiment differs from that of the first embodiment in that the fuse is situated in a different position on the conductive plate 10.

The conductive plate 10 comprises a pair of flat plates 11 and a curved plate 12 communicating with the flat plates 11. An extension plate 13 is provided to a first end portion 11*a* of the flat plates 11, and a bold opening 15*a* is formed in the center of the extension plate 13. A second end portion 11*b* of the flat plates 11 and a first end portion 12*a* of the curved plate 12 form an L-shape. An arrangement space 39 for accommodating a fuse 40 is formed between the pair of flat plates 11. The arrangement space 39 is situated in the center of the conductive plate 10.

Figure 17A:
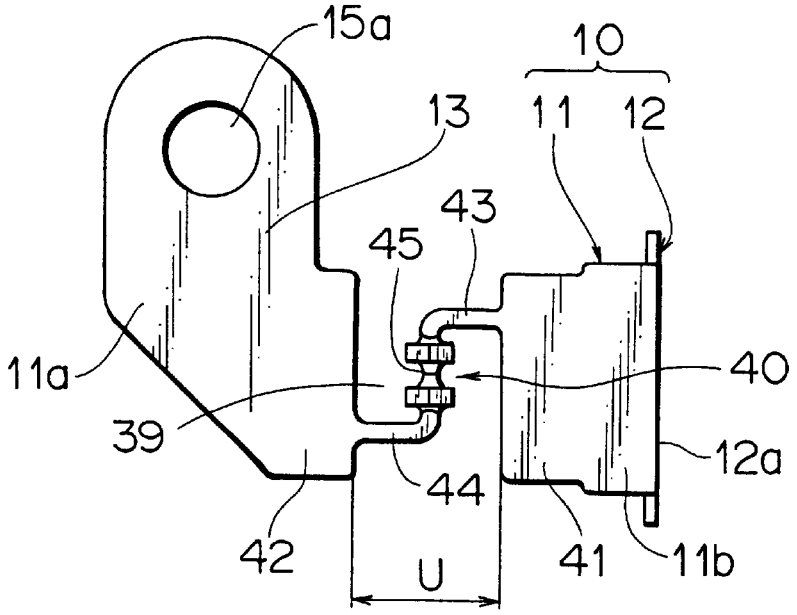
FIGS. 17A and 17B illustrate the conductive plate and the fuse of FIG. 15.

As shown in FIG. 17A, a pair of assisting plates 41 and 42 facing to each other are integrally formed between the flat plates 11, and the fuse 40 is formed between the pair of assisting plates 41 and 42. The fuse 40 comprises an L-shaped plate 43 situated above the right-side assisting plate 41, an L-shaped plate 44 situated below the left-side assisting plate 42, and a fusible element 45 disposed between the L-shaped plates 43 and 44.

Figure 17B:
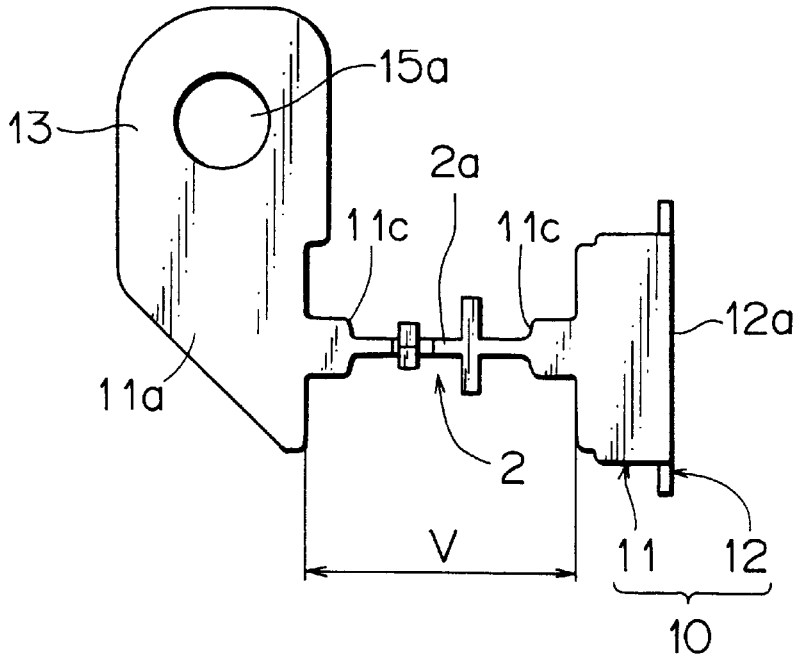

The pair of assisting plates 41 and 42 are provided in the center of the conductive plate 10 so as to narrow the arrangement space 39 without changing the size of the resin case 20 of FIG. 15. Accordingly, the space U between the assisting plates 41 and 42 becomes narrower than the space V in the center of the conductive plate 10 of the first embodiment, as shown in FIGS. 17A and 17B. The surface area of the conductive plate 10 is larger than in the first embodiment by the assisting plates 41 and 42, and the distance from the stud bolt 15 and the attachment hole 16 of the conductive plate 10 to the fuse 40 is longer than in the first embodiment.

As described above, a temperature rise in the terminal connecting portion (i.e., the stud bolt 15 and the attachment hole 16) due to the heat generated from an energized high current fuse 1D can be more effectively restricted than in the first embodiment. Thus, a temperature rise in the fuse 40 can be made smaller even when the high-current fuse 1D for vehicles is placed in a high-temperature environment.

Even if the resin case 20 and the conductive plate 10, which have different linear expansion coefficients, expand at a high temperature and put tensile stress or compressive stress onto the fuse 40, the fusible element 45 receives no adverse influence. Their linear expansion coefficients are different, because the resin case 20 is made of a resin material while the conductive plate 10 is made of metal. If the resin case 20 and the conductive plate 10 receive tensile stress or compressive stress, the L-shaped plates 43 and 44 of the fuse 40 linearly expand to be in parallel with the conductive plate 10 as the resin case 20 expands. The fusible element 45 then receives the stress. Since tensile stress and compressive stress act indirectly upon the fusible element 45, the fuse 40 can be made more durable against heat.

FIGS. 18 to 23 illustrate a fifth embodiment of the high-current fuse for vehicles in accordance with the present invention. It should be noted here that like components are indicated by like reference numerals in the foregoing embodiments and this embodiment.

Figure 18:
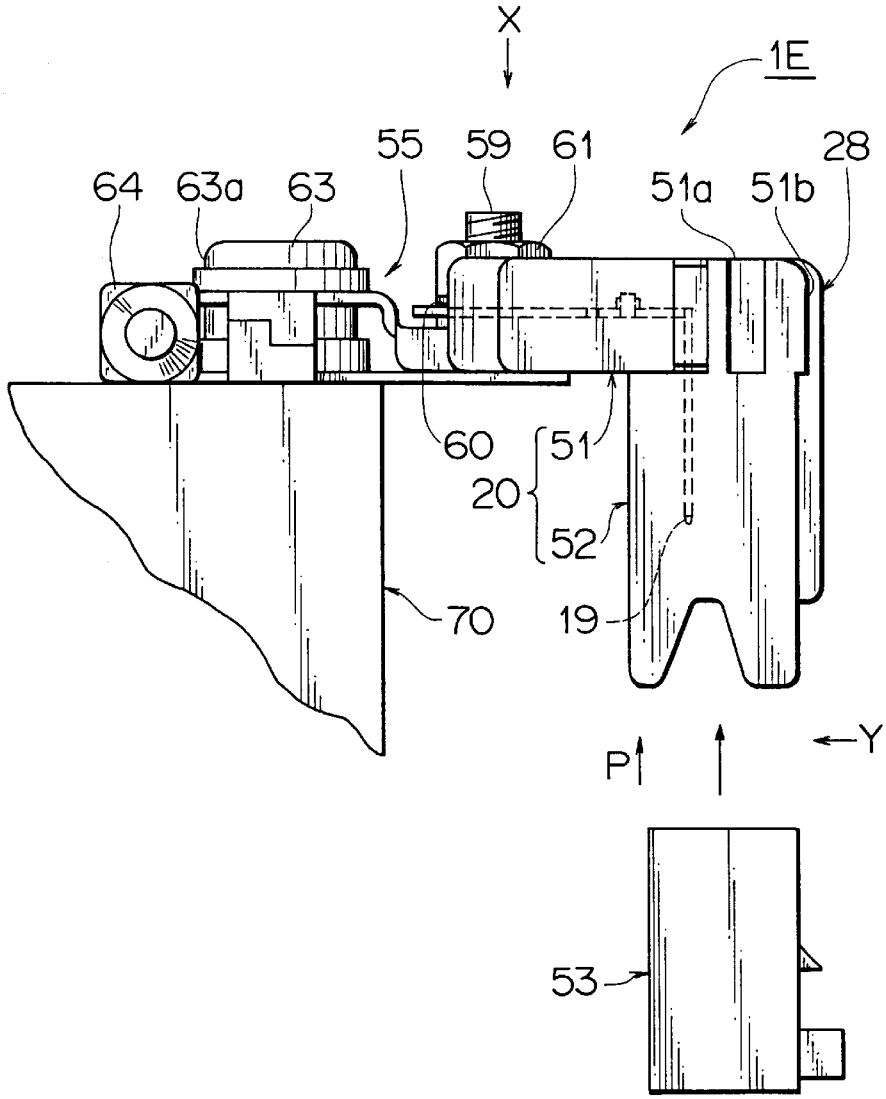
FIG. 18 is a side view of a fifth embodiment of the high-current fuse for vehicles in accordance with the present invention.

As shown in FIG. 18, the high-current fuse 1E comprises a conductive plate 10 formed by stamping a conductive metal plate (not shown), and a resin case 20 insert-molded including the conductive plate 10 inside.

Figure 20:
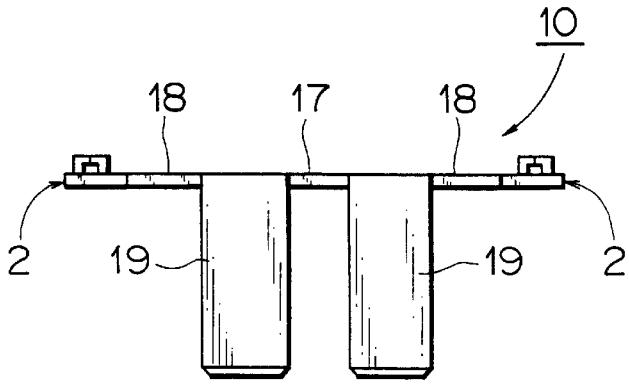
FIG. 20 illustrates the conductive plate seen in the direction of the arrow Z of FIG. 19.
Figure 19:
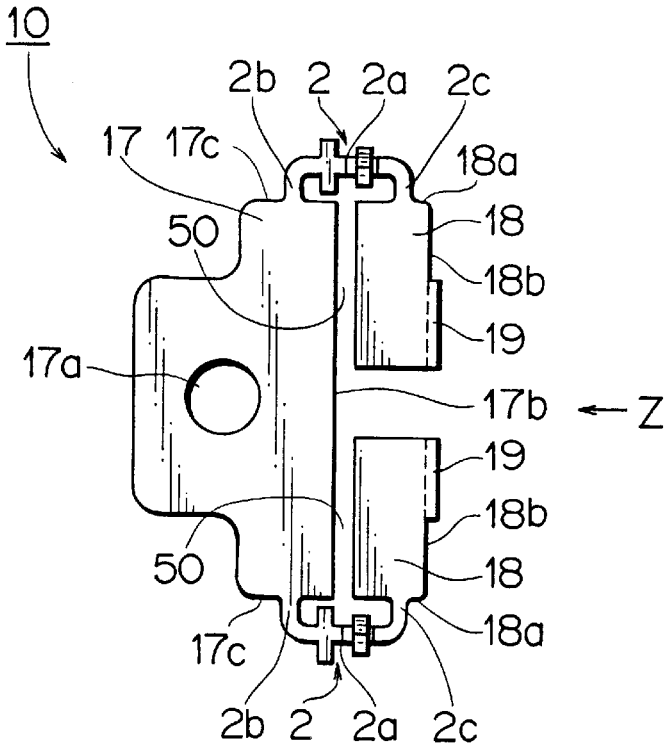
FIG. 19 is an enlarged view of the conductive plate of FIG. 18.
Figure 23:
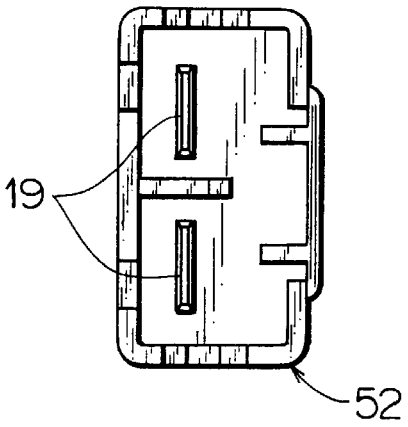
FIG. 23 illustrates the high-current fuse seen in the direction of the arrow P of FIG. 18.
Figure 24:
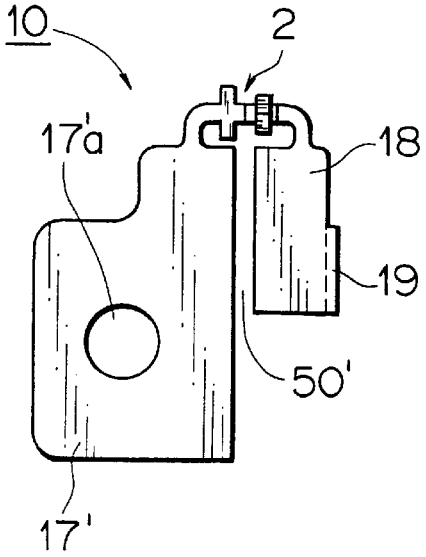
FIG. 24 illustrates a single-pole conductive plate.

As shown in FIGS. 19 and 20, the conductive plate 10 comprises a concave main plate 17, a pair of fuses 2 attached to the main plate 17, a pair of rectangular connecting plates 18 connected to the fuse 2, and a pair of tab-like terminals 19 attached to the connecting plates 18.

A connecting hole 17*a* is formed in the middle of the main plate 17. The pair of connecting plates 18 are arranged in parallel with the main plate 17 at a predetermined distance from the long side 17*b* (i.e., at a predetermined distance 50). The connecting plates 18 are in parallel with each other. The connecting plates 18 are smaller than the main plate 17 in size.

As shown in FIG. 19, each of the fuses 2 comprises a pair of legs 2*b* and 2*c*, and a fusible element 2*a* disposed between the legs 2*b* and 2*c*. The leg 2*b* is connected to the short side 17*c* of the main plate, and the other leg 2*c* is connected to a shorter wall 18*a* of the corresponding connecting plate 18.

Each of the tab-like terminal 19 is connected to a long wall 18*b* of the corresponding connecting plate 18, so that the tab-like terminal 19 is perpendicular to the connecting plate 18. The main plate 17, the connecting plates 18, the fuses 2 are all arranged on the same plane. The tab-like terminals 19 are substantially perpendicular to this plane.

Figure 21:
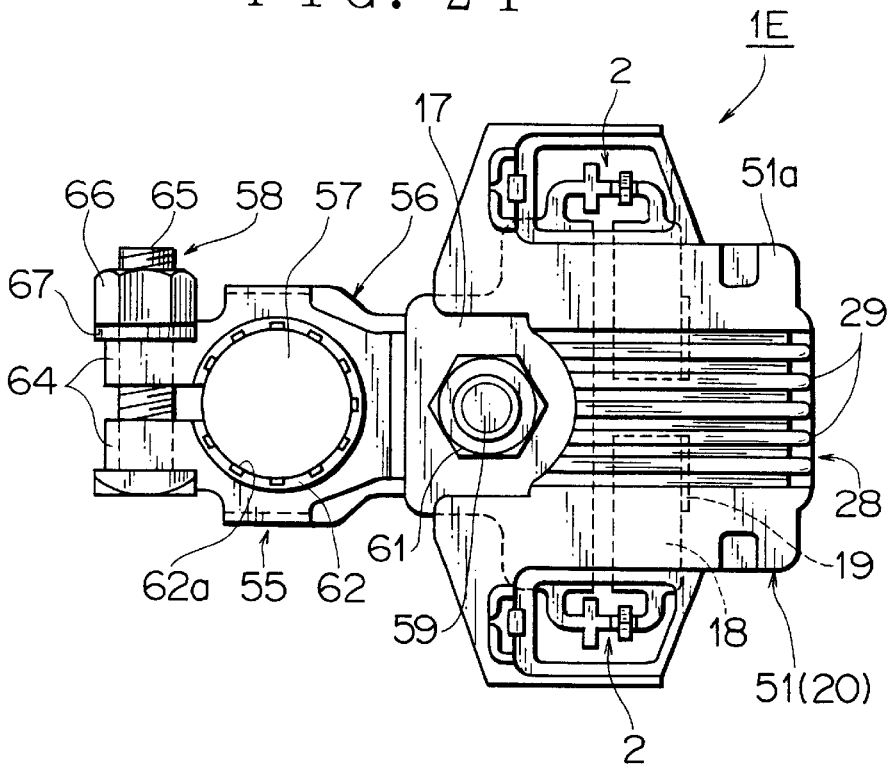
FIG. 21 illustrates the high-current fuse seen in the direction of the arrow X of FIG. 18.

As shown in FIGS. 18 and 21, the resin case 20 comprises a main cover 51 to cover the main plate 17 and the connecting plates 18, and a connector portion 52 to cover the tab-like terminals 19 so as to receive a mating connector 53. The fuses 2 and the connecting plates 18 are exposed to air without being covered with a resin material.

Figure 22:
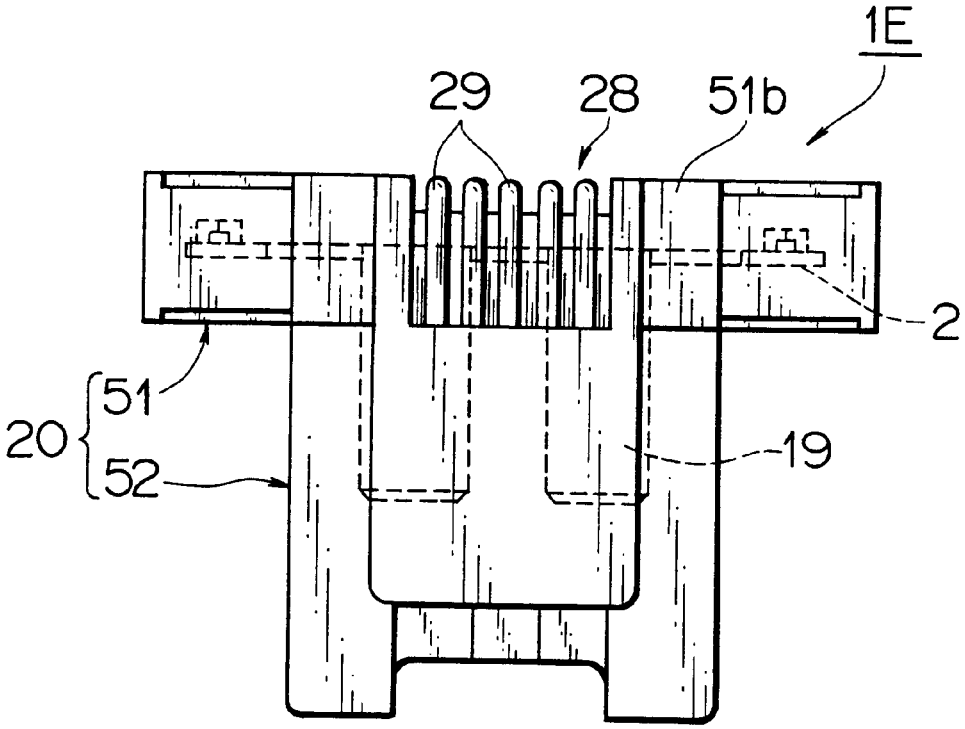
FIG. 22 illustrates the high-current fuse seen in the direction of the arrow Y of FIG. 18.
Figure 22:
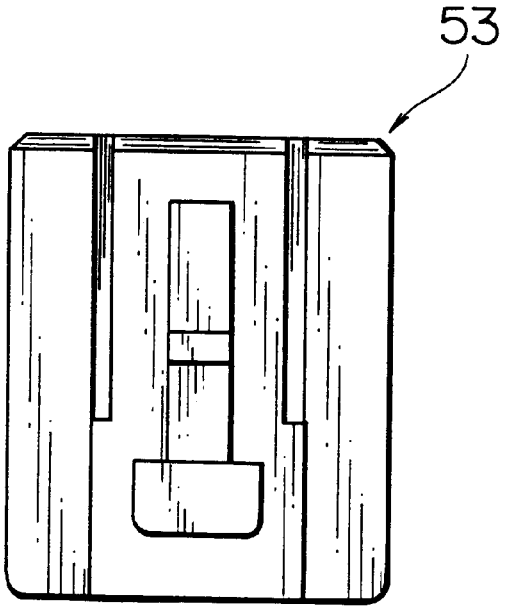
Figure 26:
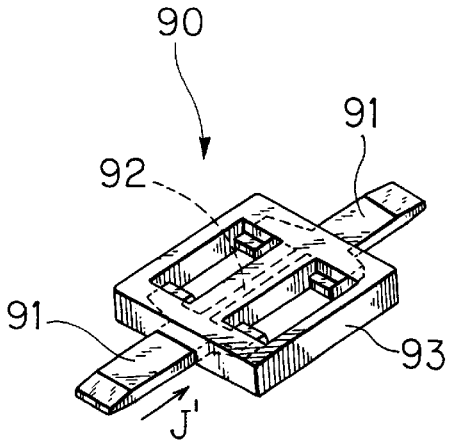
FIG. 26 is a perspective view of one example of the prior art.

As shown in FIGS. 21 and 22, a heat radiating portion 28 is disposed on the upper surface 51*a* of the main cover 51 and in parallel with the fuses 2. The tab-like terminals 19 are in parallel with a side surface 51*b*. The heat radiating portion 28 comprises a plurality of thin plates 29 at regular intervals.

As can be seen from FIGS. 18 and 21, a battery connecting terminal 55 is connected to the connecting hole 17*a* of the main plate 17. The main plate 17 can be formed in the shape of the battery connecting terminal 55, and the high-current fuse 1E is directly attached to the battery post 63 of a battery 70.

The battery connecting terminal 55 comprises a flat plate-like main terminal 56, an insertion opening 57 formed in the middle of the main terminal 56, a through hole (not shown) formed at one end of the main terminal 56, and an opening adjustment unit 58 disposed at the other end of the main terminal 56.

The main terminal 56 is formed in the U-shape so that the diameter of the insertion opening 57 can be lengthened and shortened by the opening adjustment unit 58. A connecting bolt 59 is inserted into the through hole and the connecting hole 17*a*, and a nut 61 is screwed to the connecting bolt 59 with a washer 60. Thus, the main terminal 56 and the conductive plate 10 are directly attached to each other.

A flange 62 formed around the insertion opening 57, so that the outer surface 63*a* of the battery post 63 is sealed. Longitudinal grooves 62*a* are formed on the inner surface of the flange 62, so that the battery post 63 can be secured. The battery 70 is a storage battery aboard a vehicle.

The opening adjustment unit 58 comprises a pair of contact plates 64 standing at the rear edge of the main terminal 56, a caulking bolt 65 rotatably inserted into the contact plates 64, and a nut 66 screwed to the caulking bolt 65. A screw hole (not shown) is formed through the contact plates 64, and the caulking bolt 65 is inserted into the screw hole.

The insertion opening 57 has a larger diameter than that of the battery post 63, so that the battery post 63 can be easily inserted into the insertion opening 57. After the insertion of the battery post 63, the contact plates 64 are brought closer to each other by rotating the nut 66 so as to shorten the diameter of the insertion opening 57. The contact plates 64 are tightened by the nut 66 via a washer 67, so that the flange 62 is brought into contact with the outer surface 63a of the battery post 63, thereby holding the battery post 63.

The mating connector 53 is inserted into the connector portion 52. After the insertion of the mating connector 53, a terminal (not shown) inside the mating connector 53 is electrically connected to the tab-like terminals 19 inside the connector portion 52.

Figure 27:
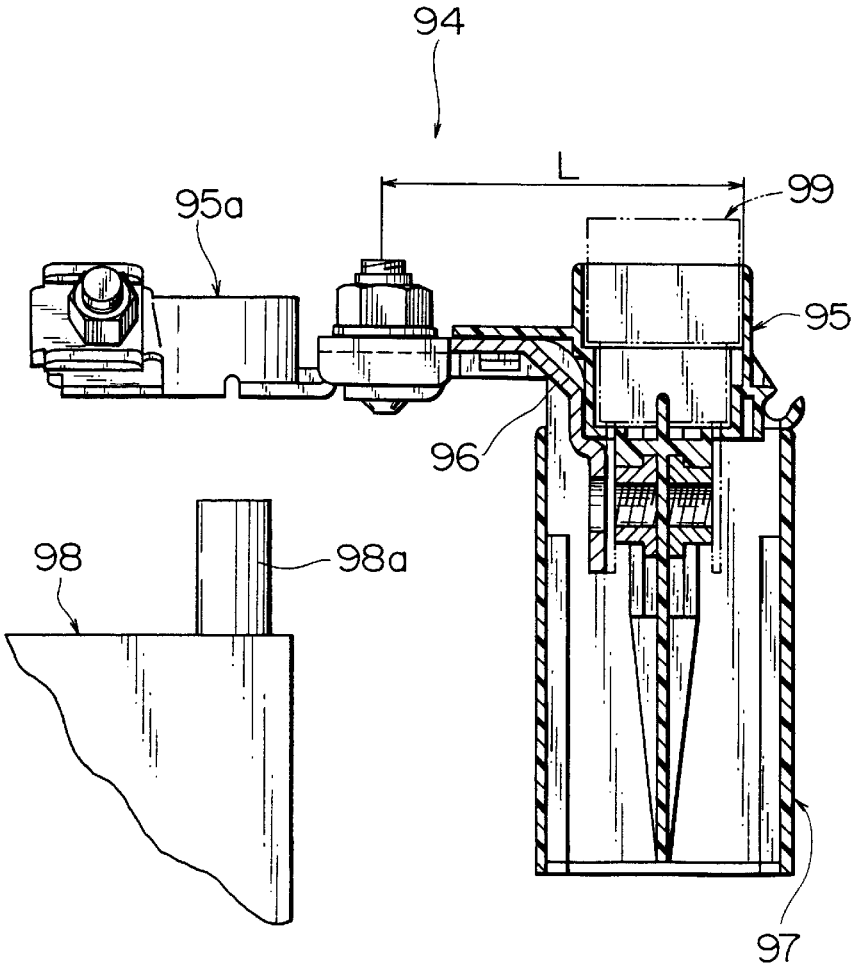
PRIOR ART FIG. 27
FIG. 27 is a partially sectional view of another example of the prior art.

Attaching a fuse directly to the battery connecting terminal 55 can reduce the number of components. As a result, the high-current fuse 1E can be made smaller. For instance, the length L in the prior art of FIG. 27 can be shortened. Also, with the heat radiating portion 28 provided to the resin case 20, a temperature rise can be restricted in the high-current fuse Modifications of the present invention include a conductive plate 10 comprising a main plate 17' and a connecting plate 18. The main plate 17' and the connecting plate 18 are arranged on the same line with a space 50' in between. A fuse 2 is connected to the main plate 17' and the connecting plate 18 so that it becomes in parallel with the line. A connecting hole 17' a is formed through the main plate 17'.

Figure 25:
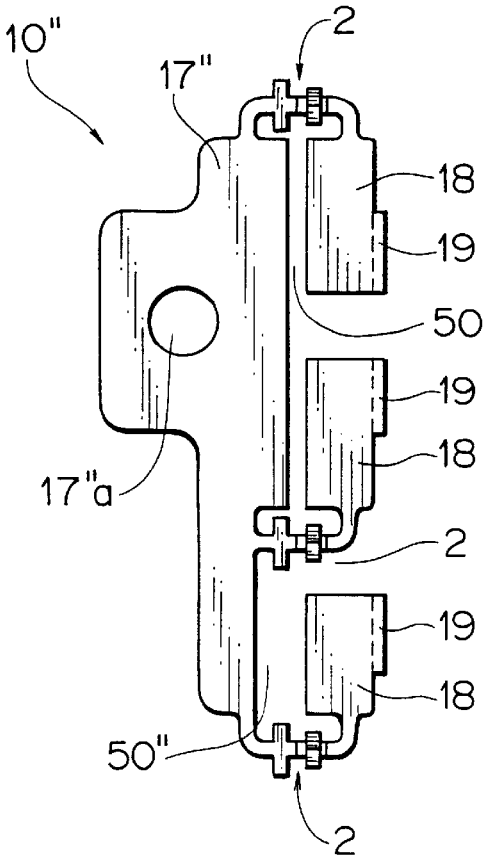
FIG. 25 illustrates a three-pole conductive plate.

As shown in FIG. 25, if there are three poles, a conductive plate 10" comprises a main plate 17" and three connecting plates 18. The three connecting plates 18 are arranged in a row and attached to the main plate 17" with spaces 50 and 50 in between. A connecting hole 17"*a* is formed through the main plate 17". In the case where there are four or more poles, the constitution should be the same as above.

In the first embodiment to the fifth embodiment, the fin-like heat radiating portion 28, and the integral molding of the conductive plate 10 and the resin case 20 are employed so as to obtain excellent heat radiation ability in the high-current fuses 1A to 1E, and also to make the fuses 1A to 1E smaller than in the prior art. However, other methods and manners may be employed, and the present invention is not limited to the above embodiments.

Also, the terminal connecting portions on both sides may be replaced with the connector portion 52. One of them can be connected to the battery connecting terminal 30 or 55, while the other can be tab-like terminals.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A high-current fuse for vehicles, comprising:

a conductive plate having a fuse and terminal connecting portions on both sides;

a resin case into which the conductive plate is insert-molded; and a heat radiating portion for releasing heat generated from the fuse and the conductive plate when energized, the heat radiating portion being disposed on an outer surface of the resin case, wherein the terminal connecting portions on both sides of the conductive plate are arranged on the same line with a space in between, and the fuse is arranged in parallel with the line, and wherein a pair of assisting plates facing to each other are integrally formed in the middle of the conductive plate, and the fuse is disposed between the pair of assisting plates and in a direction perpendicular to the energizing direction of the conductive plate.

2. A high-current fuse for vehicles, comprising:

a conductive plate having a fuse and terminal connecting portions on both sides;

a resin case into which the conductive plate is insert-molded; and a heat radiating portion for releasing heat generated from the fuse and the conductive plate when energized, the heat radiating portion being disposed on an outer surface of the resin case, wherein the terminal connecting portions on both sides of the conductive plate are arranged on the same line with a space in between, and the fuse is arranged in parallel with the line, wherein one of the terminal connecting portions is directly attached to a battery, and wherein a pair of assisting plates facing to each other are integrally formed in the middle of the conductive plate, and the fuse is disposed between the pair of assisting plates and in a direction perpendicular to the energizing direction of the conductive plate.

3. A high-current fuse for vehicles, comprising:

a conductive plate having a fuse and terminal connecting portions on both sides;

a resin case into which the conductive plate is insert-molded; and a heat radiating portion for releasing heat generated from the fuse and the conductive plate when energized, the heat radiating portion being disposed on an outer surface of the resin case, wherein one of the terminal connecting portions is directly attached to a battery, and wherein a pair of assisting plates facing to each other are integrally formed in the middle of the conductive plate, and the fuse is disposed between the pair of assisting plates and in a direction perpendicular to the energizing direction of the conductive plate.

4. A high-current fuse for vehicles, comprising:

a conductive plate having a fuse and terminal connecting portions on both sides;

a resin case into which the conductive plate is insert-molded; and a heat radiating portion for releasing heat generated from the fuse and the conductive plate when energized, the heat radiating portion being disposed on an outer surface of the resin case, wherein the heat radiating portion comprises a plurality of thin plates arranged on the resin case at regular intervals, and wherein a pair of assisting plates facing to each other are integrally formed in the middle of the conductive plate, and the fuse is disposed between the pair of assisting plates and in a direction perpendicular to the energizing direction of the conductive plate.

5. A high-current fuse for vehicles, comprising:

a conductive plate having a fuse and terminal connecting portions on both sides;

a resin case into which the conductive plate is insert-molded; and a heat radiating portion for releasing heat generated from the fuse and the conductive plate when energized, the heat radiating portion being disposed on an outer surface of the resin case, wherein a pair of assisting plates facing to each other are integrally formed in the middle of the conductive plate, and the fuse is disposed between the pair of assisting plates and in a direction perpendicular to the energizing direction of the conductive plate.

* * * * *